United States Patent [19]

Perez

[11] Patent Number: 4,873,732

[45] Date of Patent: Oct. 17, 1989

[54] TRAUMA STRETCHER

[76] Inventor: Roberto Perez, 860 Harrison Ave., #1208, Boston, Mass. 02118

[21] Appl. No.: 261,260

[22] Filed: Oct. 24, 1988

[51] Int. Cl.[4] ..... A61G 7/10

[52] U.S. Cl. ..... 5/81 B; 5/86; 414/345; 414/523; 414/921

[58] Field of Search ..... 5/81 B, 81 R, 86, 83; 414/921, 345, 523

[56] References Cited

U.S. PATENT DOCUMENTS

| | | | |
|---|---|---|---|
| 2,582,048 | 10/1950 | Gilleland | 5/86 |
| 2,691,782 | 6/1952 | West | 5/81 B |
| 3,452,371 | 7/1969 | Hirsch | 5/81 B |
| 3,786,523 | 1/1974 | Sele | 5/81 B |
| 3,792,500 | 2/1974 | Swara, Sr. | 5/81 B |
| 3,902,204 | 9/1975 | Lee | 5/81 B |
| 4,011,609 | 3/1977 | Bethlen | 5/81 B |
| 4,104,748 | 8/1978 | Brisco | 5/63 |
| 4,259,756 | 4/1981 | Pace | 5/81 B |
| 4,274,168 | 6/1981 | Depowski | 5/81 B |

*Primary Examiner*—Alexander Grosz
*Attorney, Agent, or Firm*—John P. McGonagle

[57] ABSTRACT

A trauma stretcher for use in transferring a patient to and from stretcher to bed or operating table. The stretcher includes a wheeled chassis, platform mounted thereon, patient litter slidably positioned atop said platform, extension arms with means for sliding a litter across, and stabilizer legs to prevent tipping.

8 Claims, 6 Drawing Sheets

TRAUMA STRETCHER

BACKGROUND OF THE INVENTION

This invention relates generally to hospital stretchers, and more particularly to stretchers for use in transferring a patient to and from stretcher to bed or operating table.

It is well known to those working in hospitals that, in transferring a patient between a stretcher and a bed or operating table, the stretcher is brought closely alongside the bed so that the patient may then be lifted by hospital attendants or nurses in order to be carried across the gap between the bed and stretcher. This requires two or more persons who are strong enough so as to be able to carry the patient across the gap without dropping the patient.

Various movable top stretchers are known in the art. However, except for a few elaborate and expensive mobile stretchers with movable foundations having vertical and horizontal positions, none provide a relatively inexpensive, practical and stable platform for transferring patients to and from hospital beds and operating tables. The movable top stretchers of the prior are are also very susceptible to tipping when the patient is being moved.

SUMMARY OF THE INVENTION

Therefore, it is a principal object of the present invention to provide a trauma stretcher which includes a wheeled chassis, platform mounted thereon, patient litter slidably positioned atop said platform, extension arms with means for sliding a litter across, and stabilizer legs to prevent tipping.

Another object accordingly is to provide a stretcher which allows one nurse or attendant working alone, to do the task, and without the need of great strength or requiring great effort.

Other and further objects, as well as various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
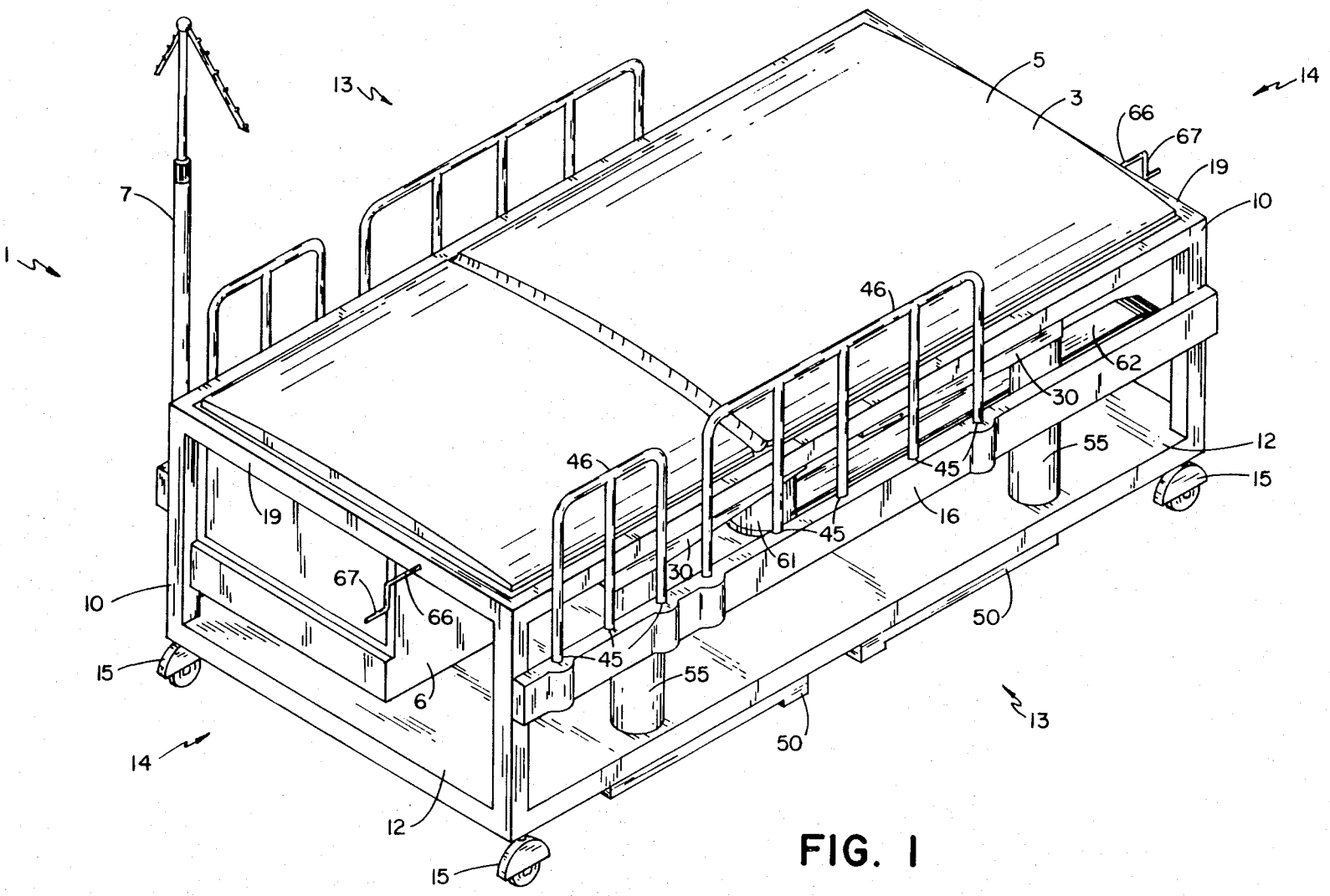
FIG. 1 is a perspective view of a trauma stretcher constructed in accordance with the present invention.
Figure 2:
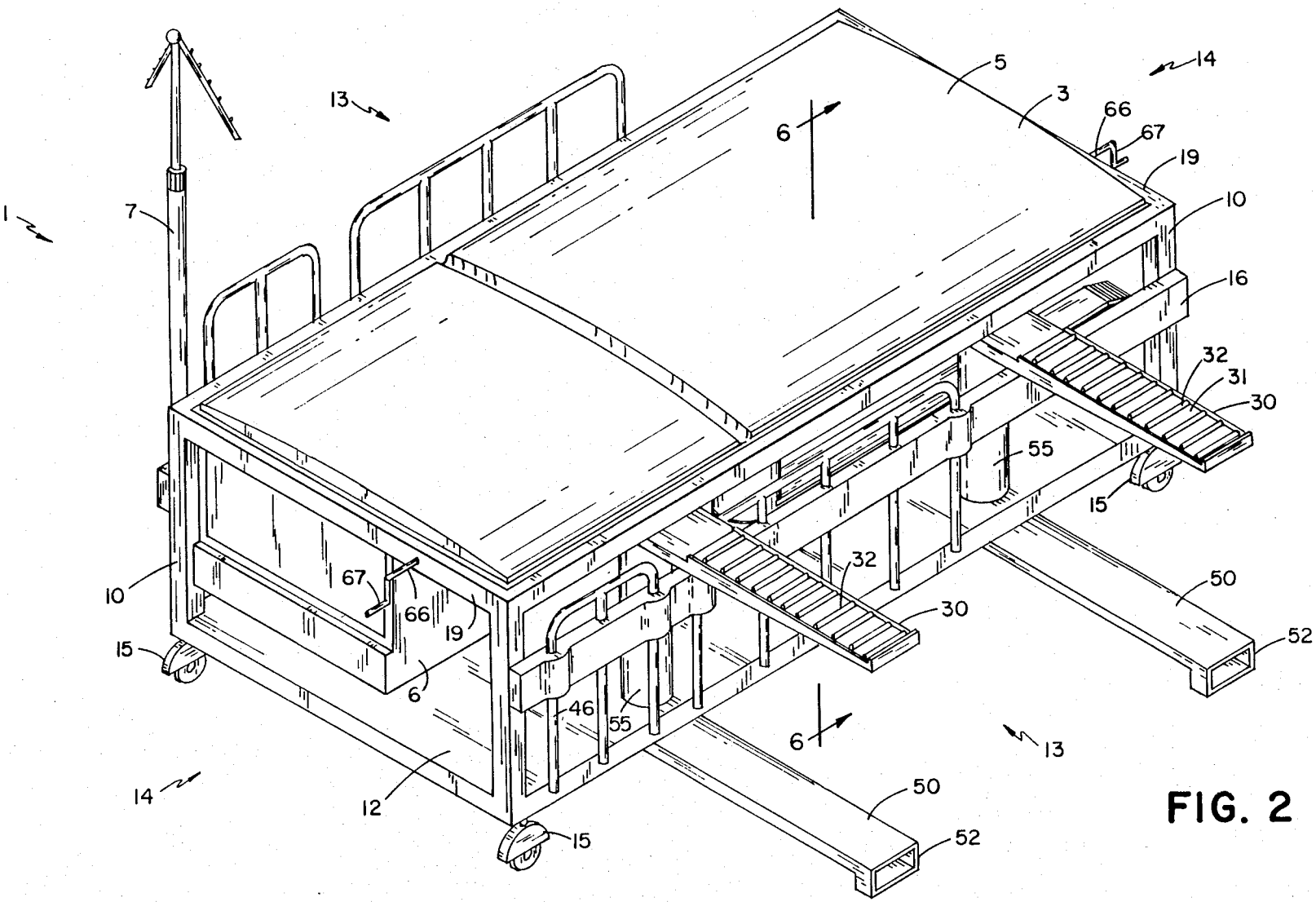
FIG. 2 is a perspective view thereof with side arms and legs extended.

Referring to the drawings in detail wherein like numerals indicate like elements, reference numberal 1 refers to a trauma stretcher constructed in accordance with the present invention. The stretcher 1 is comprised of a wheeled chassis 10 in which the mechanical features of the present invention are incorporated. The chassis 10 has a generally rectangular, box-like frame with a top 11, bottom 12, two sides 13 and two ends 14. The ends 14, sides 13 and top 11 are generally open. The bottom 12 is comprised of a solid, flat, tray-like base. The bottom 12 is fixedly mounted on four pivotal wheel assemblies 15. The chassis 10 has a reinforcing side bar 16 attached on each side 13 at each side's approximate vertical midpoint and extending horizontally along the frame's longitudinal axis end-to-end 14.

Figure 3:
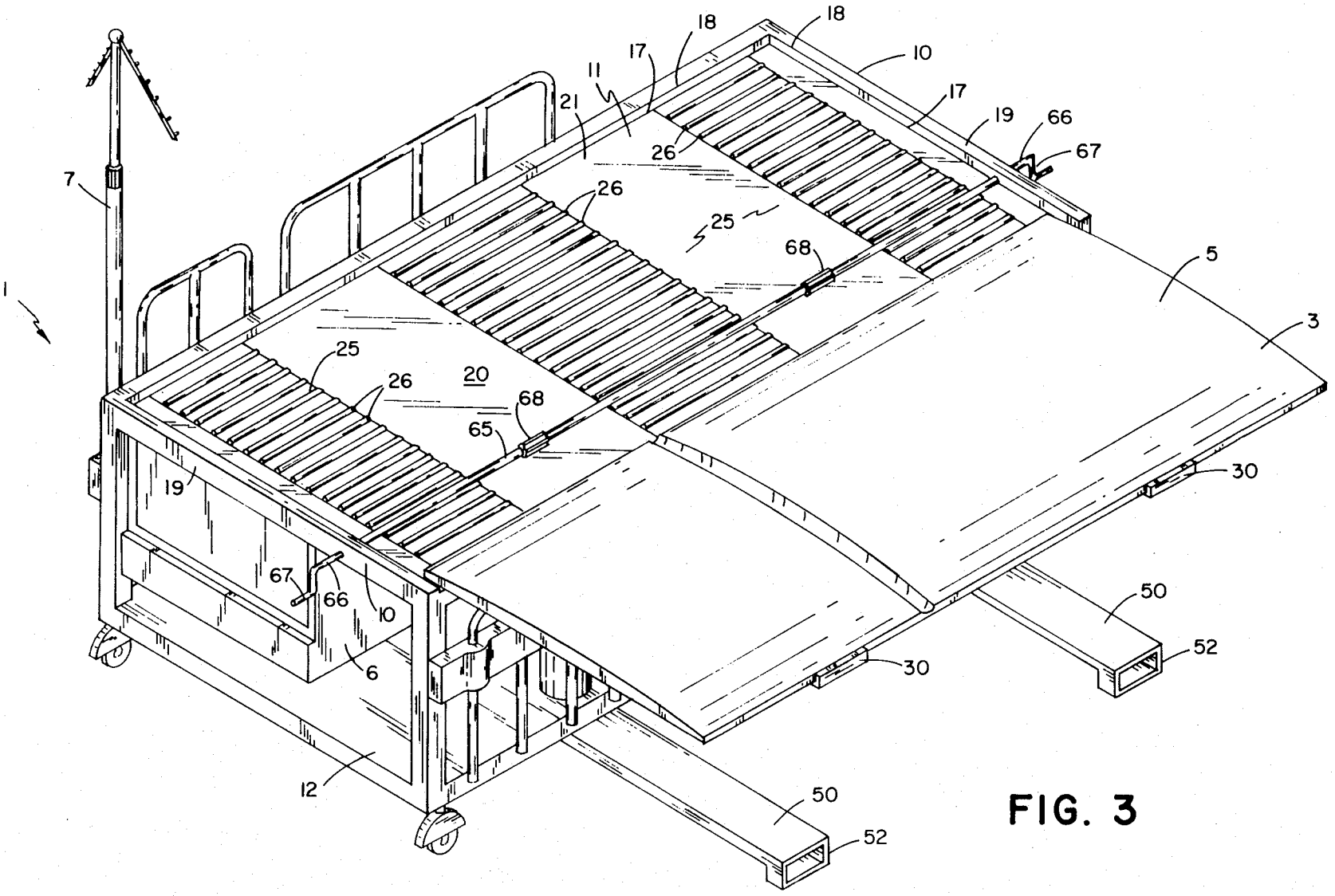
FIG. 3 is a perspective view thereof with litter slid onto the extended side arms.
Figure 4:
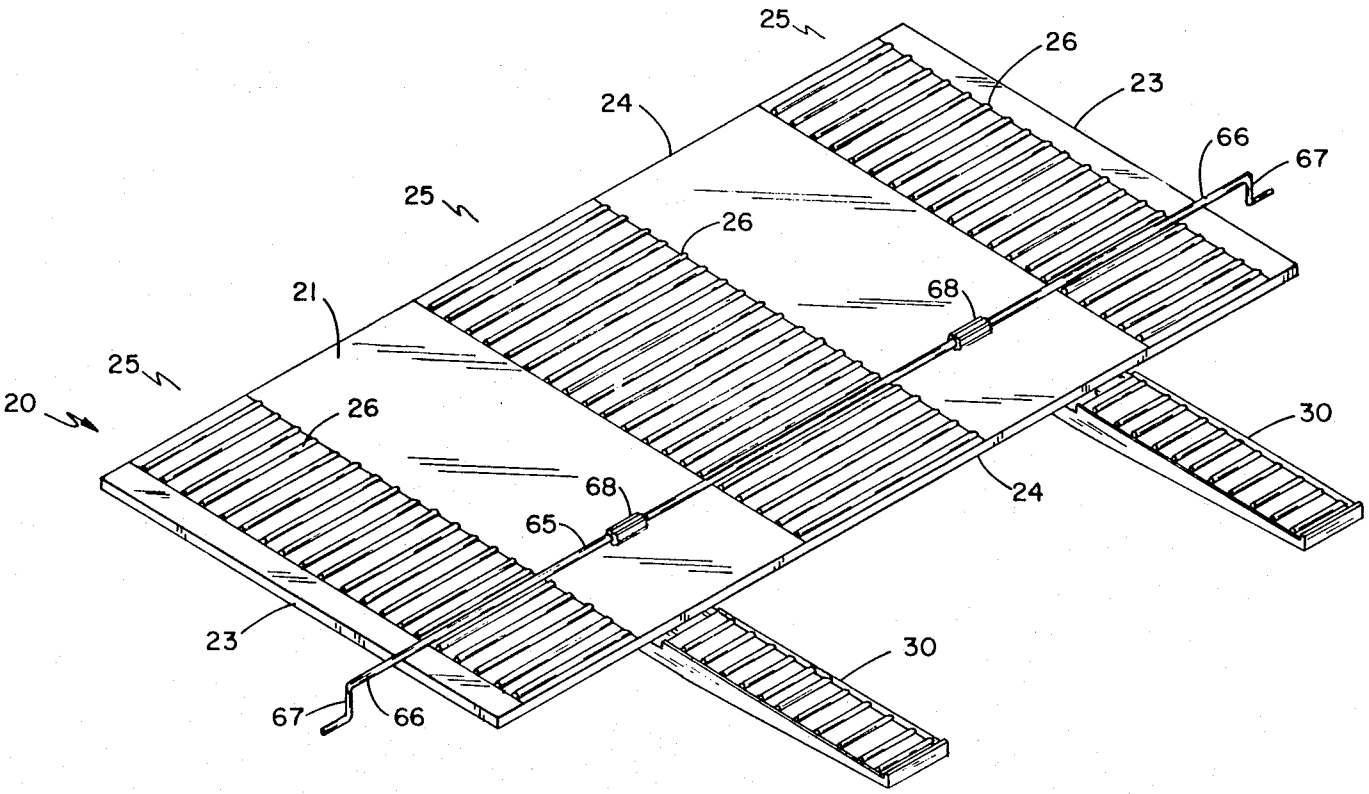
FIG. 4 is a perspective view in section of the platform and side arms thereof.
Figure 5:
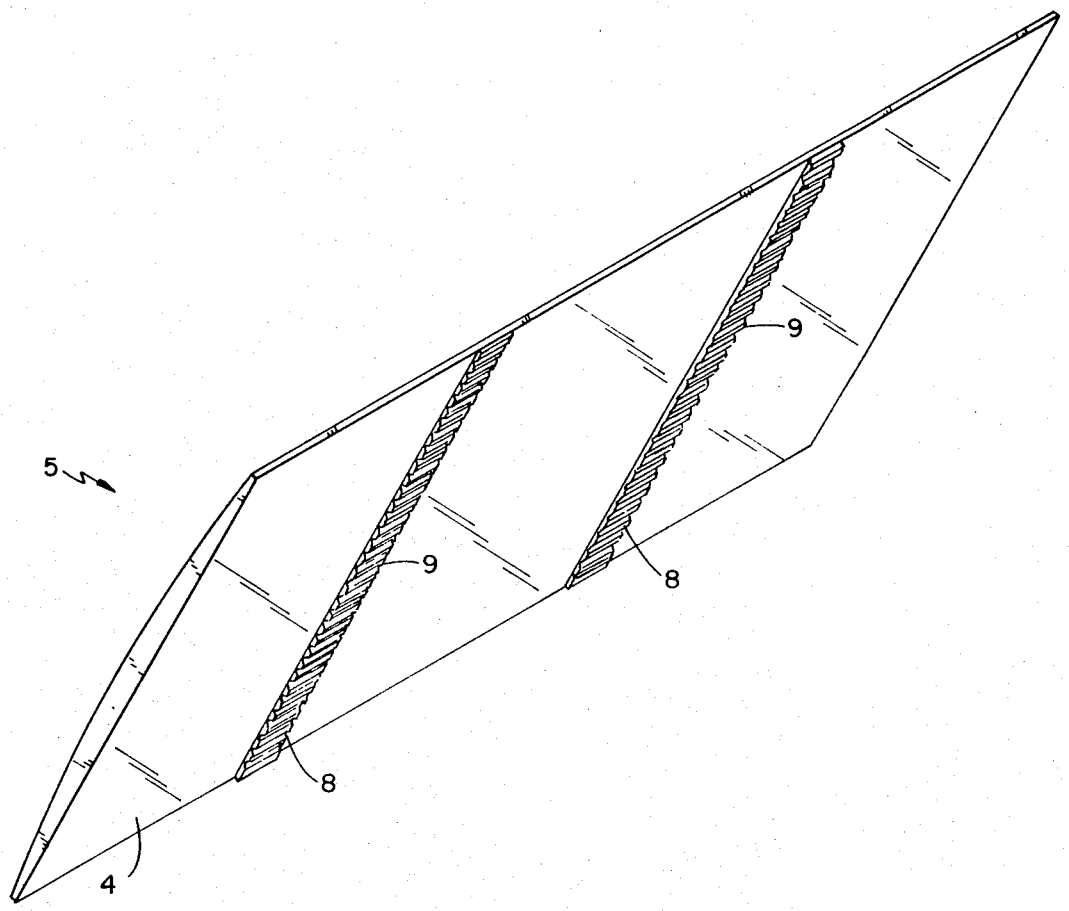
FIG. 5 is a bottom perspective view of the litter thereof.
Figure 6:
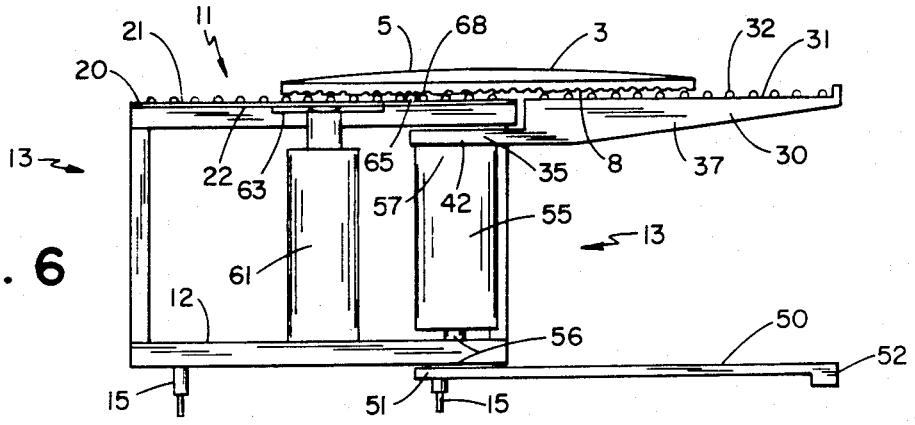
FIG. 6 is a sectional view along the line 6—6 of FIG. 2 thereof.
Figure 7:
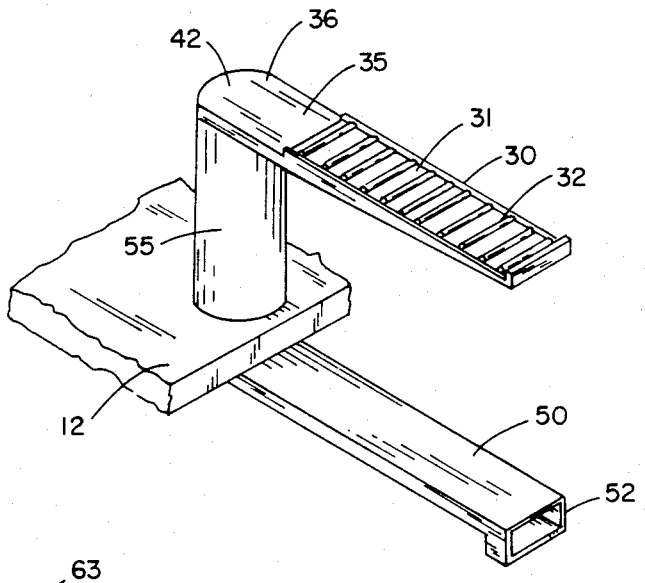
FIG. 7 is a perspective view in section of a side arm and corresponding support leg thereof.
Figure 8:
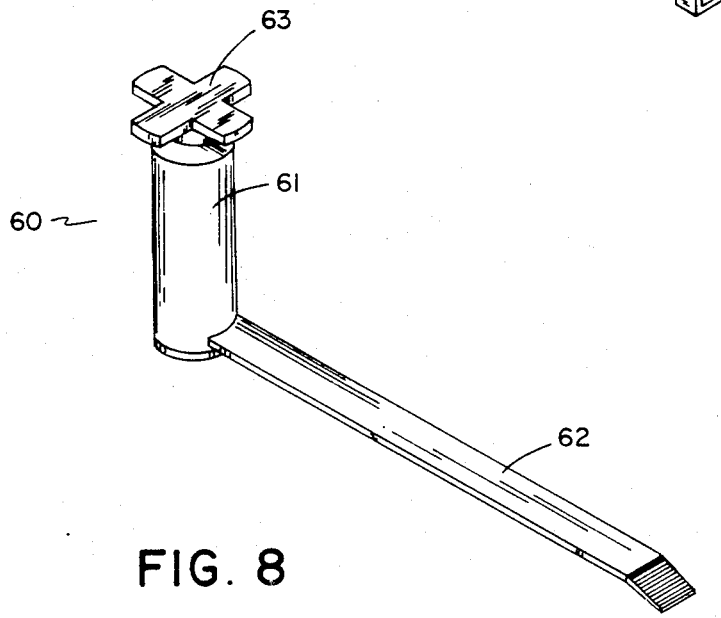
FIG. 8 is a perspective view in section of the pumping apparatus thereof.

As may be best understood from FIGS. 3 and 4, a platform 20 with top 21 and bottom 22 faces is fitted onto the top 11 of the chassis 10. The platform 20 is generally flat and also has two sides 24 and two ends 23. The platform's top face 21 has three rows 25 of roller bars 26. One row 25 is positioned near to each platform end 23 and the third row 25 is positioned across the middle of the platform 20. The rows 25 are parallel to each other and are positioned so that each row 25 is oriented perpendicularly to the platform's longitudinal axis and each individual roller bar 26 is oriented parallel to the platform's longitudinal axis.

A rod 65 is positioned across the platform's top face 21 in line with the longitudinal axis of the platform 20. The rod's ends 66 are inserted through the top end crossbars 19 of the chassis frame 10. The rod's ends 66 terminate in turning handles 67. The rod 65 has two machined knurled gears 68 formed concentrically about its surface circumference. The gears 68 are positioned along the rod 65 so that each gear 68 is positioned between the roller bar middle row 25 and one of the end roller bar rows 25.

Four arms 30 are pivotally fixed to the chassis 10, two on each side 13. The arms 30 are positioned near to the chassis top 11 and are pivotable into the chassis 10 and perpendicular out from a chassis side 13. On the upper surface 31 of each arm 30 are roller bars 32 oriented so that when each arm 30 is perpendicular to a chassis side 13 each arm roller bar 32 is parallel to the platform roller bars 26. The arms 30 in their extended position with respect to the chassis 10 are positioned with respect to the platform 20 so that the arms 30 are aligned between the platform roller bar rows 25.

To provide stability during patient transfer operations the stretcher 1 has contained within extensible support legs 50, two on each side 13 in vertical planes with the arms 30. Each leg 50 has two ends, one end 52 braced against the floor or ground surface when the leg 50 is extended, and the other end 51 connected to the bottom 56 of a vertical, cylindrically-shaped, support strut 55. The top end 57 of the strut 55 is connected to the innermost end 42 of an arm 30 directly above the leg 50. There are four arms 30 with four legs 50 in a generally mirror arrangement. As a particular arm 30 is extended sideways from the stretcher 1, a corresponding support leg 50 simultaneously extends sideways from the chassis 10 with the arm 30.

A generally rectangular patient litter 5, which may be a stretched frame, mattress, board or any of the other generally flat devices used for supporting patients, is positioned atop the platform 20. The litter 5 has two faces, an upper face 3 upon which the patient is laid, and a lower face 4 which rests on the platform 20. The litter 5 has two rows 8 of teeth-like indentations 9 across its lower face 4. The rows 8 are transverse to the longitudinal axis of the liter 5 and are so positioned that the rod's knurled gears 68 will engage the indentations 9 when the litter 5 is placed atop the platform 20.

The primary purpose of the trauma stretcher 1 is the transportation and movement of patients from one surface to another without the need for several attendants and without the need for jostling the patient or requiring the patient to make the actual transfer. The stretcher's arms 30 may be pivoted outwardly in pairs on either side 13 of the stretcher 1. When an arm 30 is fully extended a portion 35 of the arm 30 remains within the chassis 10. The upper surface 36 of the inside portion 35 of the arm 30 is flat and in a lower plane than the upper surface 31 of the arm's outside portion 37. When an arm 30 is fully extended, it rises approximately one inch so that the plain of the arm roller bars 32 will match the plane of the platform roller bars 26. The patient litter 5 may thereupon be moved from the platform 20 across the extended arms 30 over the platform roller bars 26 and the arm roller bars 32, and vice versa. The motion of the litter 5 is controlled by the rod 65. As either or both turning handles 67 are acted upon, the rod 65 is radially turned, causing the gears 68 to turn. Since the gears 68 engage the litter's indentations 9, the litter 5 will move across the roller bars 26 and 32.

For further stability, the platform 20 is actually inserted into the chassis top 11. As may be best understood from FIG. 3, the chassis top 11 has an interior ridge 17 below the edge 18 of the chassis top 11. The platform 20 rests on the ridge 17. The depth of the ridge 17 is such that when the patient litter 5 is placed thereon, it actually sits on the platform 20 within the chassis top edge 18. For patient transfer operations the platform 20, with or without the litter 5, must be raised. This is accomplished by a pumping apparatus 60 contained within the chassis 10 at its approximate midpoint. The pumping apparatus 60 is comprised of a vertical hydraulic or pneumatic lifting and lowering section 61 operated and controlled by a foot lever 62. The vertical section 61 drives a flat, cross-like section 63 braced against the bottom face 22 of the platform 20, thereby lifting and lowering the platform 20 as needed. The pumping apparatus 60 is fastened to the chassis bottom 12.

To increase the practicality of the stretcher 1 and for patient safety, railing inserts 45 are provided along the reinforcing side bars 16 into which railings 46 are inserted. The chassis 10 has a box 6 contained therein where various medical equipment such as patient monitoring apparatus, communications equipment and the like may be installed. The stretcher 1 also has attached thereto a pole 7 where I.V.s and the like may be suspended.

It is understood that the above-described embodiment is merely illustrative of the application. Other embodiments may be readily devised by those skilled in the art which will wmbody the principles of the invention and fall within the spirit and scope of the invention thereof.

I claim:

1. A trauma stretcher for use in transferring a patient to and from stretcher to bed or operating table, comprising:

a generally rectangular wheeled chassis frame with a top, bottom, two sides and two ends;

a generally flat rectangular platform with top and bottom faces mounted thereon the platform's top face having a plurality of rows of roller bars whereby said rows are parallel to each other and are positioned so that each row is perpendicularly oriented to the platform's longitudinal axis and each individual roller bar is oriented parallel to the platform's longitudinal axis;

a rectangular patient litter with top and bottom faces slidably positioned atop said platform;

a plurality of extension arms pivotally attached to the sides of said chassis and having means for sliding said litter across;

a plurality of stabilizer legs pivotally attached to the sides of said chassis; and a rod with two ends and a plurality of knurled gears formed concentrically about its surface circumference wherein said rod is positioned across the platform's top face in line with the longitudinal axis of the platform and having its ends inserted through top end crossbars forming a portion of the chassis frame.

2. A stretcher as recited in claim 1 wherein:

the litter has a plurality of rows of teeth-like indentations across its lower face transverse to the longitudinal axis of the litter and so positioned that said rod's knurled gears will engage said indentations when the litter is placed atop the platform.

3. A stretcher as recited in claim 2 wherein:

the rod's ends terminate in turning handles.

4. A stretcher as recited in claim 3 wherein:

said arms are positioned near to the chassis top and are pivotable into the chassis and perpendicular out from a chassis side.

5. A stretcher as recited in claim 4 wherein:

each arm has an upper surface containing a plurality of roller bars oriented so that when each arm is perpendicular to a chassis side each arm roller bar is parallel to the platform roller bars.

6. A stretcher as recited in claim 5 wherein:

said chassis has contained within a plurality of vertical support struts.

7. A stretcher as recited in claim 6 wherein:

each stabilizer leg has two ends, one end braced against a ground surface when the leg is extended and the other end pivotally connected to the bottom of a said vertical support strut.

8. A stretcher as recited in claim 7 wherein:

each arm has an innermost end pivotally connected to the top of a said vertical support strut.

* * * * *